US007950435B2

(12) United States Patent
Lee

(10) Patent No.: US 7,950,435 B2
(45) Date of Patent: May 31, 2011

(54) DISPENSER OF ADHESIVE TAPE

(76) Inventor: Dong Soo Lee, Seoul (KR)

( * ) Notice: Subject to any disclaimer, the term of this patent is extended or adjusted under 35 U.S.C. 154(b) by 929 days.

(21) Appl. No.: 11/855,058

(22) Filed: Sep. 13, 2007

(65) Prior Publication Data

US 2008/0135181 A1 Jun. 12, 2008

(30) Foreign Application Priority Data

Dec. 8, 2006 (KR) ..... 10-2006-0124880
Feb. 28, 2007 (KR) ..... 10-2007-0020445
Jun. 26, 2007 (KR) ..... 10-2007-0063115

(51) Int. Cl.
*B65H 35/07* (2006.01)

(52) U.S. Cl. ..... 156/527; 156/577; 156/579

(58) Field of Classification Search ..... 156/523, 156/527, 574, 577, 579
See application file for complete search history.

(56) References Cited

U.S. PATENT DOCUMENTS 5,928,466 A * 7/1999 Yu Chen ..... 156/527
6,152,398 A * 11/2000 Chen ..... 242/588
6,789,594 B1 * 9/2004 Yu Chen ..... 156/523
2007/0267455 A1 * 11/2007 Huang ..... 225/20

* cited by examiner

*Primary Examiner* — Mark A Osele
(74) *Attorney, Agent, or Firm* — Kirton & McConkie; Evan R. Witt

(57) ABSTRACT

A convenient adhesive tape dispenser with improved cutting operation of the adhesive tape at a lower part of a case body. The adhesive tape dispenser includes a case body having a body case formed with a holding part to mount an adhesive tape inside, a coupling case coupled with the body case and formed with an assembling space at a rear part, and a cover case formed with a fitting piece at a front part to be coupled in the assembling space. The case body is formed with a mounting hole at a front part and an exposure space at an upper part of the mounting hole. A cutter part is mounted in a mounting hole of the case body. An elastic pressing plate is positioned at an upper part of the holding part for pressing the adhesive tape downward elastically to keep tension when the adhesive tape is released.

7 Claims, 5 Drawing Sheets

DISPENSER OF ADHESIVE TAPE

BACKGROUND OF THE INVENTION

1. Field of the Invention

The present invention relates to a dispenser of an adhesive tape, of which cutting operation is improved conveniently at a lower part of a case body for promoting convenience of use.

In general, an adhesive tape is a tape used for adhering a paper or other articles, wherein the adhesive tape is received in a case as being wound in the shape of roll and the case is provided with a cutter at a front end to cut the adhesive tape.

A dispenser for an adhesive tape with a relatively large, so-called a box tape has been disclosed in Korean Patent No. 604436. In the disclosure, a case body is molded with a width relatively large and mounted with a lever for operating a cutting element, wherein the operation of the lever is controlled at an upper part, so that the dispenser is applicable for the wide box tape and the like.

2. Discussion of Related Art

The prior art dispenser of an adhesive tape has a case usually molded in a size much larger than a width of an adhesive tape.

Therefore, the dispenser may be used compatibly for various adhesive tapes, which are manufactured with different per manufacture, regardless of the kind of the adhesive tape or the manufactures.

The prior art dispenser of the box tape has a cutter mounted at a front end of the case body to cut the box tape, wherein a blade of the cutter is exposed outside the body part always, causing problems in the workability and safety.

Therefore, Korean Patent Application No. 2006-124880 suggested a dispenser in which a cutter blade is exposed to the outside when required and protected by a cover when the dispenser is not in use.

The prior art structure for protecting the cutter blade has, however, a disadvantage that the operation structure is relatively complicated and assembled via lots of steps and such a disadvantage causes the increase of manufacturing cost and the decrease of the assembling performance.

The prior art dispenser having the case of which an inner width is larger than that of the adhesive tape has another disadvantage that the adhesive tape wound in the shape of roll is lack of tension and apt to be released when a user adheres the adhesive tape to a required position of a box and the like.

Therefore, sufficient tension is not applied to the adhesive tape from a releasing-starting position to a releasing-ending position and the adhesive tap is apt to be released more than a required length by releasing inertial under a loose state.

In this case, the tape becomes adhered to the required position loosely or winkles are generated, deteriorating adhesion conditions.

Further, the tape released more than the required length disturbs next work by being adhered together, thereby causing inconvenience and delay in the adhesion work.

Therefore, the present invention is derived to resolve the above and any other disadvantages of the prior art.

According to the present invention, there is an object to provide a dispenser of an adhesive tape for carrying out taping work smoothly in a short time with proper tension by applying proper pressure to an adhesive tape, thereby helping next work to be carried out without delay.

The present invention has another object provide a dispenser of an adhesive tape, which has a cutting guide unit for exposing a cutting blade to a lower part of a case body when the dispenser is in use, thereby improving convenience of use and safety.

The present invention has still another object to provide a dispenser of an adhesive tape of which reliability is improved.

SUMMARY OF THE INVENTION

In order to achieve the above objects, according to the present invention, there is provided a dispenser of an adhesive tape including a case body having a body case formed with a holding part to mount an adhesive tape inside, a coupling case coupled with the body case and formed with an assembling space at a rear part, and a cover case formed with a fitting piece at a front part to be coupled in the assembling space, wherein the case body is formed with a mounting hole at a front part and an exposure space at an upper part of the mounting hole; a cutter part mounted in a mounting hole of the case body; and an elastic pressing plate positioned at an upper part of the holding part for pressing the adhesive tape downward elastically to keep tension when the adhesive tape is released.

The elastic pressing plate presses the adhesive tape by own elasticity, so that the adhesive tape is released with proper tension in the case of taping work, as if a user released the adhesive tape by holding the adhesive tape with his fingers.

Therefore, the adhesive tape is adhered to an article uniformly without any loose or irregular adhesion or getting loose.

Further, the adhesive tape, which is wound in the shape of roll, is prevented from being released more than a required length by inertia, so that the sticking of the released adhesive tape part may be prevented.

BRIEF DESCRIPTION OF THE DRAWINGS

The objects, features and advantages of the present invention will be more clearly understood from the following detailed description in conjunction with the accompanying drawings, in which.

DETAILED DESCRIPTION OF THE PREFERRED EMBODIMENTS

Now, a dispenser of an adhesive tape according to the present invention will be described in more detail in the structure and operation thereof with reference to the accompanied drawings.

Figure 1:
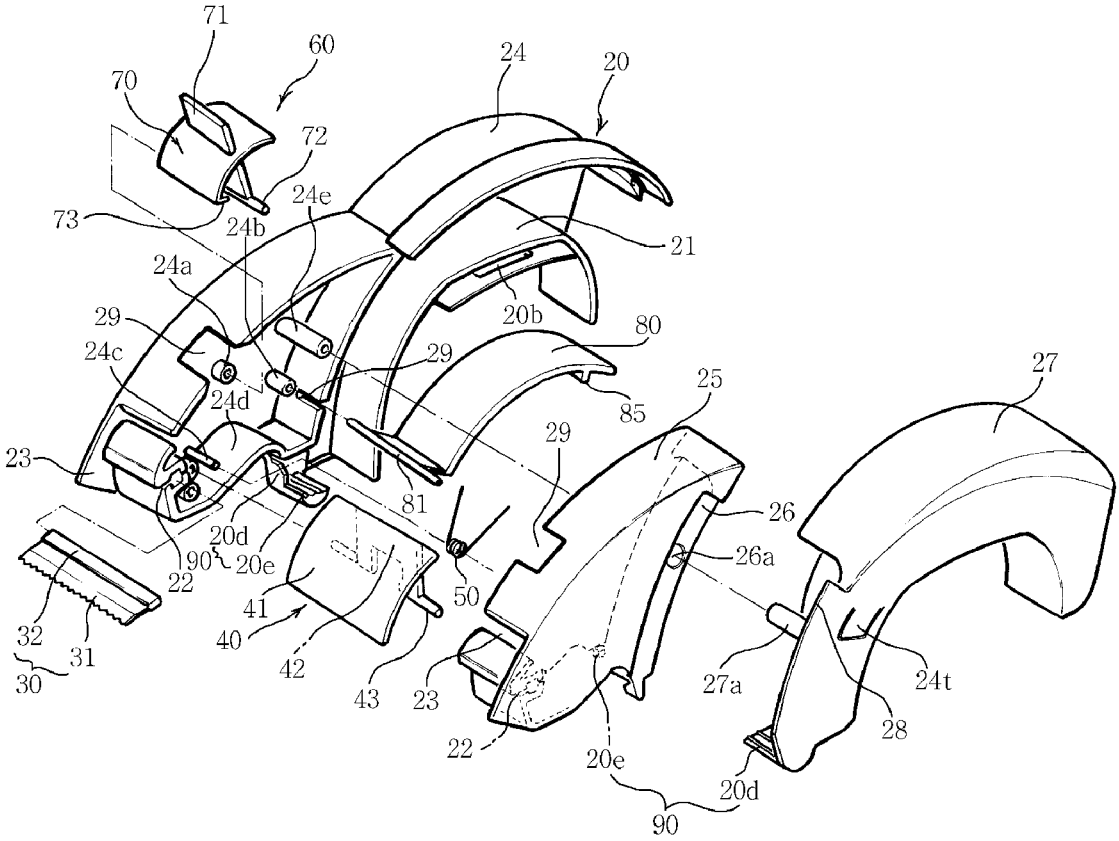
FIG. 1 is a perspective view showing a structure of a dispenser of an adhesive tape according to a preferred embodiment of the present invention, wherein the dispenser of an adhesive tape is in the disassembled state.

FIG. 1 is a disassembled perspective view showing a structure of a dispenser of an adhesive tape according to a preferred embodiment of the present invention, wherein a cutter protecting cover and a cutter controller are assembled into a body case and a cover case, which form a case body.

Figure 2:
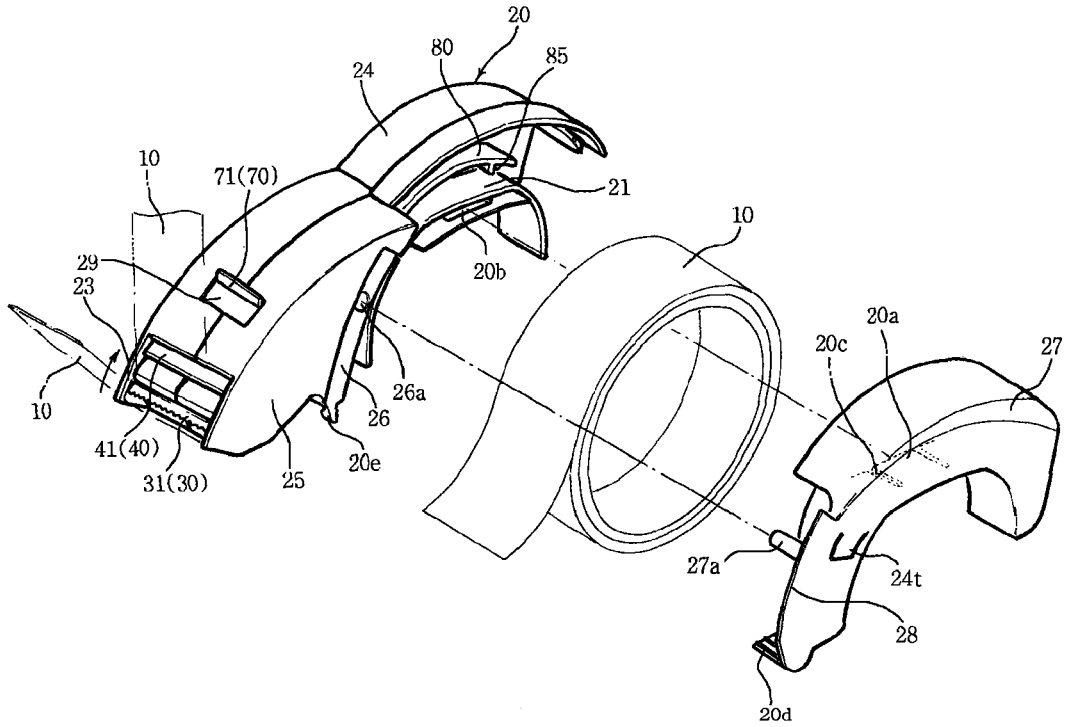
FIG. 2 is a disassembled perspective view showing a coupling structure between a body case and a cover case according to the present invention.

FIG. 2 is a disassembled perspective view showing a coupling structure between the body case and the cover case for mounting an adhesive tape therebetween.

Figure 3:
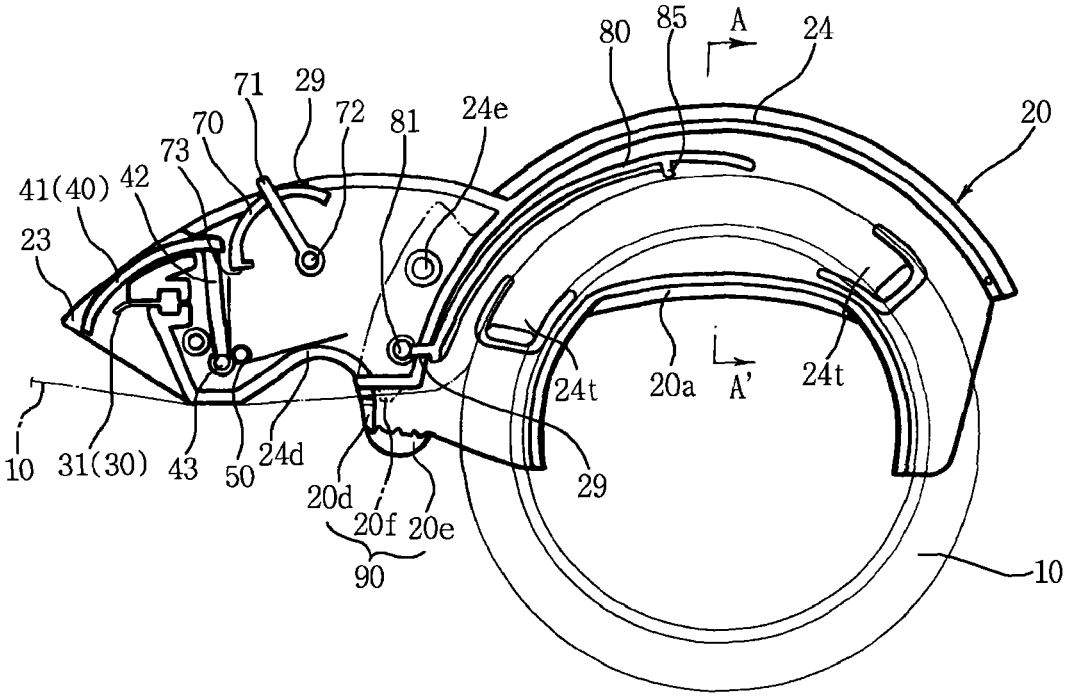
FIG. 3 is a cross-sectional view showing a blocking plate locked by a cutter controller.

FIG. 3 is a cross-sectional view showing a blocking plate locked by a cutter controller.

Figure 4:
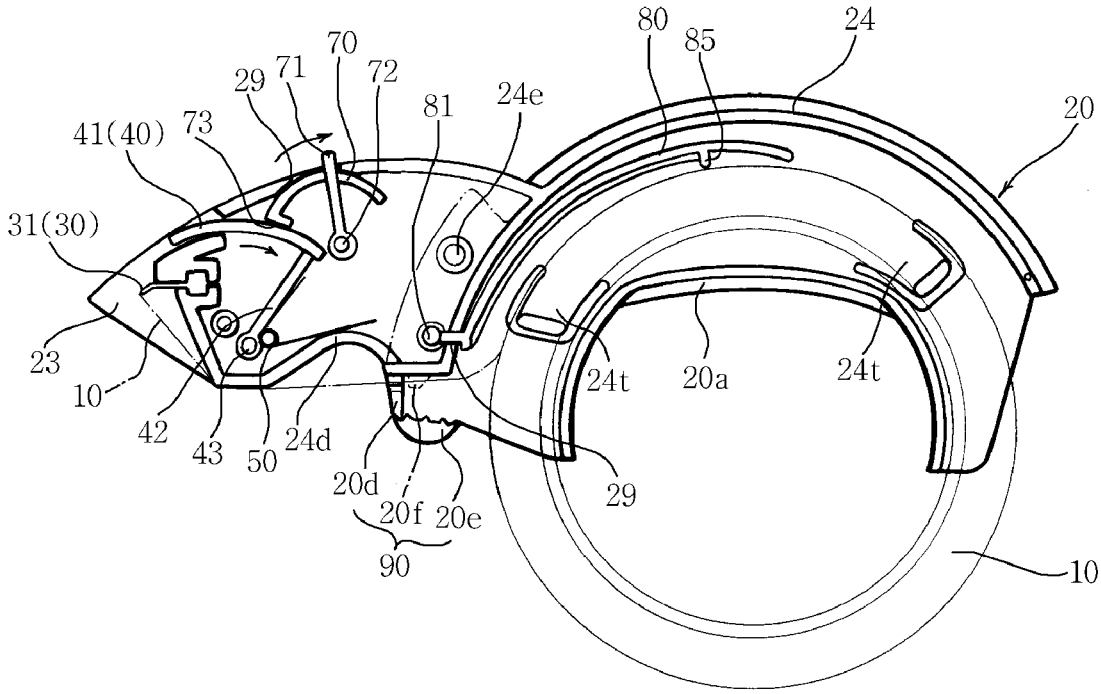
FIG. 4 is a cross-sectional view showing the blocking plate unlocked by the cutter controller.

FIG. 4 is a cross-sectional view showing the blocking plate unlocked by the cutter controller.

Figure 5:
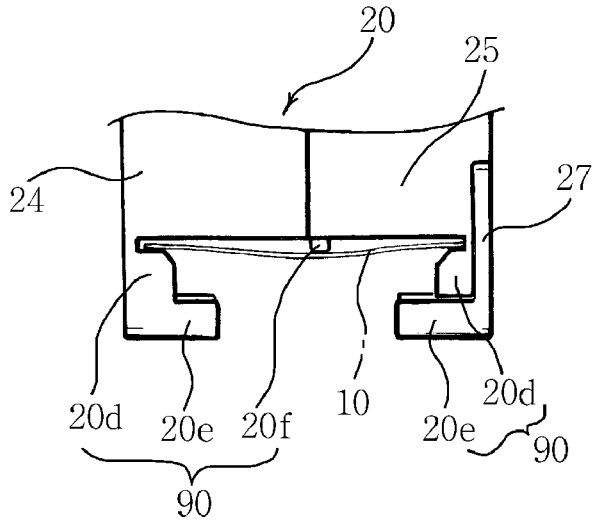
FIG. 5 is an expanded view showing principal parts for preventing slackening of an adhesive tape according to the present invention.

FIG. 5 is an expanded view showing principal parts for preventing slackening of an adhesive tape according to the present invention.

Figure 6:
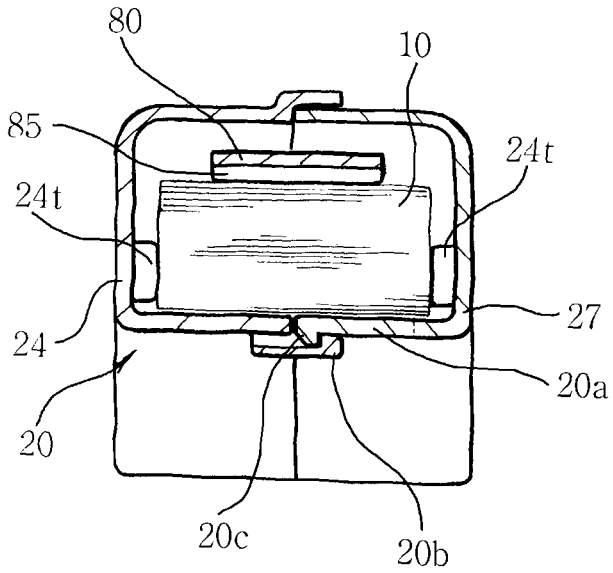
FIG. 6 is a cross-sectional view taken along line A-A' of FIG. 3.

FIG. 6 is a cross-sectional view taken along line A-A' of FIG. 3, and

Figure 7:
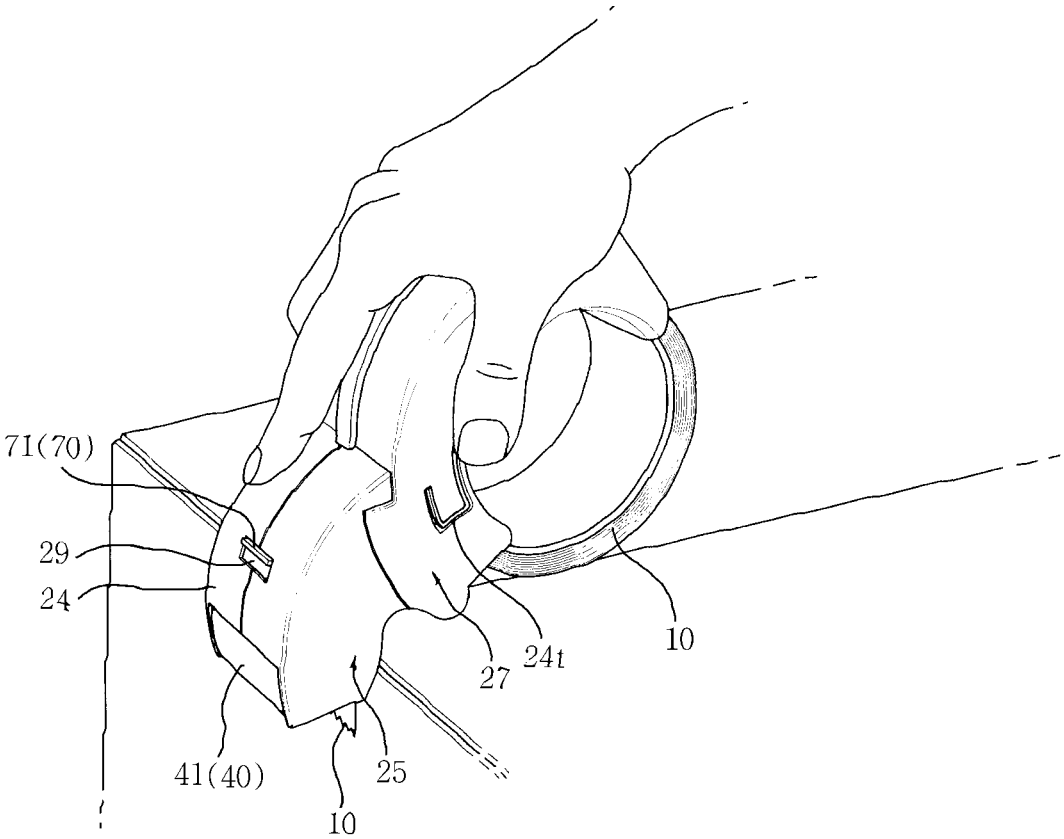
FIG. 7 is a perspective view showing the usage of the dispenser of an adhesive tape according to the present invention.

FIG. 7 is a perspective view showing the usage of the dispenser of an adhesive tape according to the present invention.

Figure 8:
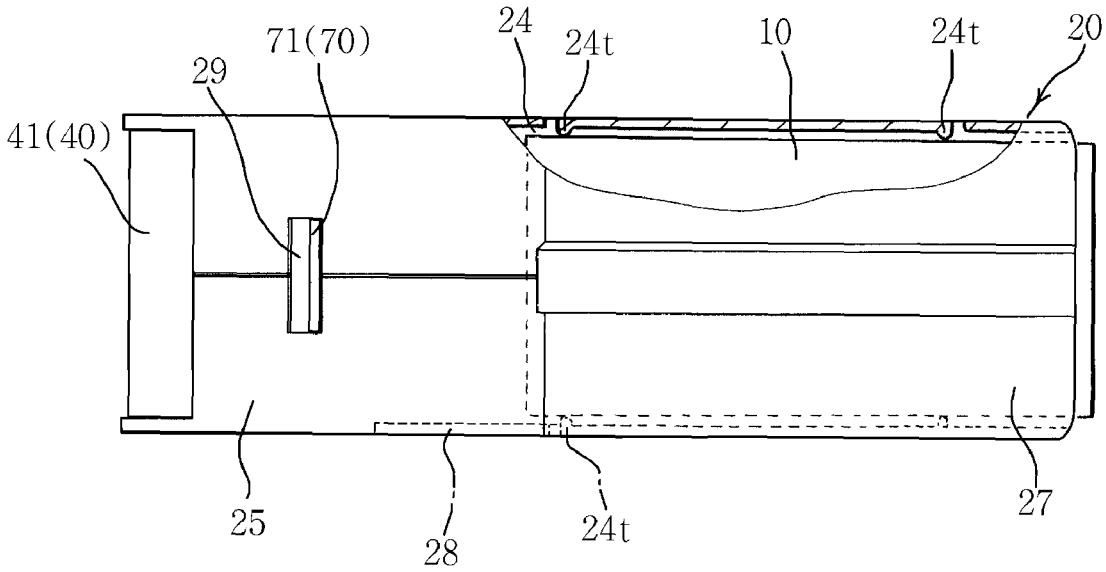
FIG. 8 is a partially taken plane view of the dispenser of an adhesive tape according to the present invention.

FIG. 8 is a partially taken plane view of the dispenser of an adhesive tape according to the present invention, wherein side surface parts of an adhesive tape are elastically supported by elastic pieces.

Referring to FIG. 1 to FIG. 7, a dispenser of an adhesive tape according to the present invention presses an adhesive tape 10 by own elasticity of an elastic pressing plate 80, so that proper tension is applied to the adhesive tape 10 during taping work as if the adhesive tape was released while being held by fingers of a user.

A cutter protecting cover 40 preferably exposes a cutter part from a case body 20 only when the adhesive tape is to be cut, thereby improving safety.

A cutter controller 60 controls the operation of the cutter protecting cover for promoting the convenience of use and simplifying the entire structure of the dispenser to reduce manufacturing cost.

The case body 20 is formed of a pair of right and left case parts approximately symmetrical with each other and detachably coupled with each other. A holding part 21 is formed in a hollow inside of the coupled case parts, wherein the adhesive tape 10 wound in the shape of cylindrical roll is held in the holding part 21 as being surrounded by the holding part 21.

The case body 20 includes a body case 24 having the holding part 21 to mount the adhesive tape 10 inside, a coupling case 25 formed with an assembling space 26 at a rear part, and a cover case 27 formed with a fitting piece 28 at a front part to be coupled in the assembling space.

The coupling case 25 is formed with a mounting hole 22 at a front part and an exposure space 23 at an upper part of the mounting hole 22.

The holding part 21 is formed approximately in the semicircular shape in the body case 24 and defined in the cylindrical shape by coupling the body case 24 with the coupling case 25 and the cover case 27.

The elastic pressing plate 80 is formed at an upper part of the holding part 21 for preventing movement of the adhesive tape 10 from an upper part thereof and pressing the adhesive tape with uniform elasticity from the upper part when releasing the adhesive tape 10.

The elastic pressing plate 80 is formed with a coupling pin 81 at a front end to be fitted into bosses 24*b*, which are respectively formed in the body case 24 and the finishing case 27, so that the elastic pressing plate 80 is mounted at an upper part of the holding part 21.

Therefore, the elastic pressing plate 80 applies elastic force to the adhesive tape 10 in the pressing direction at an end position thereof while the coupling pin 81 is fitted into the bosses 24*b* and inserted into a fitting hole 29.

The elastic pressing plate 80 is injection molded with synthetic resin approximately in the shape of arc, wherein an end 85 of the elastic pressing plate 80 is designed with a size to slightly press a roll made with paper in the natural state after the adhesive tape 10 wound on the roll is fully consumed in the holding part 21.

As a new adhesive tape 10 wound thickly on a roll is newly mounted to the holding part 21, the elasticity applied from the end 85 of the elastic pressing plate 80 becomes increased. The elasticity becomes decreased proportionally as the new adhesive tape 10 is consumed and the thickness thereof becomes decreased.

The end 85 of the elastic pressing plate 80 is kept in the elastic contact with an outer surface of the adhesive tape 10 and keeps the tension of the adhesive tape 10, even though the adhesive tape 10 is consumed entirely. Therefore, the elastic pressing plate 80 induces that the adhesive tape 10 is prevented from moving during taping work and released under the uniform tension.

The body case 24 and the cover case 27 of the case body 20 are preferably formed with elastic pieces 24*t* integrally. The elastic pieces 24*t* are slightly protruded from the body case 24 and the cover case 27 inward in the U-shape and integrally connected to the body case 24 and the cover case 27 in a direction, wherein protruded free ends of the elastic pieces 24*t* have elasticity.

The elastic pieces 24*t* are protruded from the body case 24 and the cover case 27 inward at a position or at two positions as shown in the accompanied drawings, and elastically support side surfaces of the adhesive tape 10.

Therefore, the elastic pieces 24*t* and the elastic pressing plate 80 elastically press a circumferential surface and side surfaces of the adhesive tape 10 together so as to prevent movement of the adhesive tape 10 and keep proper tension during the taping work.

A user may press the elastic pieces 24*t* forcibly by hands if the elastic supporting force of the elastic pieces 24*t* for the adhesive tape 10 is not sufficient.

If the user presses ends of the elastic pieces 24*t* slightly by fingers when holding the case body 20 by hands, the inward protruded ends may apply pressure to the side surfaces of the adhesive tape 10, thereby realizing the taping work with the proper tension similar to the proper force applied by hands holding the adhesive tape 10 directly.

At this time, slip-preventing protrusions may be formed outside the elastic pieces 24*t* for helping the user to press the elastic pieces 24*t* conveniently and preventing slip of the user's finger.

As described above, the adhesive tape 10 may be kept in the proper tension to be released by a length corresponding to movement of the case body 20 without holding the adhesive tape 10 by hands directly, thereby preventing withdrawing failure of the adhesive tape 10.

Therefore, if the user can carry out taping work while holding the case body 20 by a hand, as shown in FIG. 7.

The body case 24 is formed with fixing bosses 24*a*, 24*e* inside for assembling the coupling case 25 and the cover case 27 into the body case 24.

The body case 24 and the coupling case 25 are formed with mounting hole portions symmetrically so that a cutter part 30 is fitted therein toward a front end of the body case in an assembled state.

The coupling case 25 is formed with the assembling space 26 with a stepped difference backward and the cover case 27 is formed with a fitting piece 28 in the complementary shape and size with the assembling space 26, so that the fitting piece 28 is fitted into the assembling space 26.

In order to determine an assembling position, the coupling case 25 is formed with an assembling hole 26*a* and the fitting piece 28 of the cover case 27 is formed with a fitting protrusion 27*a*, so that the cover case 27 is assembled into the coupling case 25 at a precise position always.

In the case body 20, a guide unit 90 is formed at lower center parts of the body case 24 and the coupling case 25 and a lower front part of the cover case 27 for preventing slackening of the adhesive tape 10.

The guide unit 90 includes protruded guide pieces 20*d*, 20*e* symmetrically formed in the center of lower parts of the body case 24 and the cover case 27, and a protrusion piece 20*f* protruded downward in the center of a lower part of the coupling case 25.

Therefore, the taping work is carried out under the situation that a center part of the adhesive tape 10 is smoothly bent in the shape of "V" by the protrusion piece 20*f*, which is protruded downward in the center of the coupling case 25, and both sides of the adhesive tape 10 are supported by the guide pieces 20*d*, 20*e* not to be slackened. Conclusionally, instant and fast taping work may be realized by without any slackening of the adhesive tape, which is relatively thin.

A coupling unit is provided at a bottom surface of the holding part 21 defined by the body case 24 and the cover case 27 for the assembling or disassembling therebetween carried out when exchanging the adhesive tap 10 with a new one.

That is, a hook piece 20*a* having a hook protrusion 20*c* at an end is formed at a bottom surface of the cover case 27 and a holding protrusion 20*b* is formed at a bottom surface of the body case 24, so that the holding protrusion 20*b* is held by the hook protrusion 20*c* for keeping the coupling state between the body case 24 and the cover case 27.

In order to disassemble the cover case 27 from the body case 24, the hook piece 20*a* is lifted in a direction represented by an arrow in FIG. 6 and the hook protrusion 20*c* is released from the holding protrusion 20*b*.

The exposure space 23 is formed at an upper part of the mounting hole 22 of the case body 20. The exposure space 23 is formed of exposure space portions respectively formed at front surfaces of the body case 24 and the coupling case 25, and the cutter part 30 is mounted in the mounting hole 22 of the case body 20.

The cutter protecting cover 40 is preferably mounted to finish and protect the cutter part 30. The cutter protecting part 40 has a supporting plate 42 approximately vertically formed at a rear surface of an arc-shaped blocking plate 41 integrally and axial supporting pins 43 formed at both sides of the supporting plate 42.

The blocking plate 41 is positioned in the exposure space of the case body 20 for opening or closing the cutter part 30 by a return spring 50, which is explained blow, when the adhesive tape 10 is cut.

The axial supporting pins 43 are fitted into the bosses 24*b* for rotating the cutter protecting cover 40 axially.

A side of the return spring 50 closely contacts an inner lower supporting body 24*d* of the body case 24 while the return spring 50 is mounted to a fixing rod, which is formed in the body case 24. Further, the other side of the return spring 50 is supported by an inner bottom surface of the case body 20, so that the cutter protecting cover 40 guiding the cutter part 30 may rotate axially under elastic supporting of the return spring 50.

According to the present invention in the above described structure, the cutter protecting cover 40 blocks an upper part of the exposure space 23 of the cutter part 30 by the elasticity of the return spring 50 normally, thereby protecting the cutter part 30 not to be exposed.

When the user withdraws the adhesive tape 10 to cut, the cutter protecting cover 40 is freely opened by withdrawing a manipulation plate 70 of the cutter controller 60 after the adhesive tape 10 is withdrawn by a desired length and taped on an article, as shown in FIG. 3 and FIG. 4.

As the cutter protecting cover 40 is applied with force further after the cutter protecting cover 40 contacts a cutting position of the adhesive tape 10, the cutter protecting cover 40 rotates axially in a lifting direction while pressing the return spring 50 so that the cutter part 30 becomes exposed and cutting is carried out by a cutting blade 31.

Therefore, the cutter protecting cover 40 is lifted and the cutting blade 31 cuts the adhesive tape 10 if the user simply presses the front surface part of the case body 20 at the cutting position desired by the user.

After the taping work is finished, the manipulation plate 70 of the controller 60 is moved forward for controlling the opening of the cutter protecting cover 40. Therefore, the cutter protecting cover is prevented from moving back and the cutting blade 31 is prevented from being exposed, even though the cutter protecting cover 40 is applied with force further in the opening direction.

The cutter controller 60 controlling the cutter protecting cover 40 is mounted in the fitting hole 29 at the upper part of the coupling case 25.

The manipulation plate 70 has a contact plate 71 slidably fitted in the fitting hole 29 and a hinge shaft 72 at both lower sides.

The hinge shaft 72 of the manipulation plate 70 is mounted in the fixing bosses 24*a* in the body case 24 and the coupling case 25 for controlling operation of the blocking plate 41 of the cutter protecting cover 40.

When withdrawing the adhesive tape 10, as shown in FIG. 3, the manipulation plate 70 blocks the operation of the blocking plate 41 of the cutter protecting cover 40 at a rear part thereof. The blocking plate 41 moves back when he user moves the contact plate 71 at an upper part of the manipulation plate 70 backward for cutting the adhesive tape 10 by the cutter part 30.

The cutter controller 60 in the above structure moves in the counterclockwise direction together with the manipulation plate 70 by the elasticity of the return spring 50 in an initial state, so that the blocking plate 31 blocks the exposure of the cutter part 30, as shown in FIG. 3.

When cutting the adhesive tape 10, the contact plate 71 of the manipulation plate 70 is moved back and pressed, so that the blocking plate 41, which blocks the exposure of the cutting plate 30, moves to a lower part of the manipulation plate 70 by the return spring 50. Therefore, the cutter part 30 becomes exposed and carries out the cutting of the adhesive tape 10.

The blocking plate 41 is recovered to an initial state by restoring force of the return spring 50 if the user releases the contact plate 71 of the manipulation plate 70.

A guide surface 73 is formed at a front lower part of the manipulation plate 70 for improving contact-movement of the blocking plate 41 and the manipulation plate 70, thereby securing smooth workability through surface-contact.

As described above, the cutter controller 60 prevents the opening of the cutter protecting cover 40 by the elasticity of the return spring 50 in a free state when the adhesive tape 10 is attached to a desired article, and moves the manipulation plate 70 by slightly pulling the manipulation plate 70 to the right in the drawings at the position requiring the cutting.

Then, the blocking plate 41 contacts a right end of the cutter controller 60 even though the blocking plate 41 is moved back, as shown in FIG. 4. Therefore, the prevention of the movement of the blocking plate 41 is released, so that the operation of the cutter protecting cover 40 becomes free and the adhesive tape 10 is cut by the operation of the cutter part 30 as described above.

Therefore, the cutter protecting cover 40 is converted to an opening-free state and the cutting work for the adhesive tape 10 is carried out safely and conveniently by the cutter part 30.

The cutter part 30 mounted in the mounting hole 22 of the case body 20 is fitted in the mounting hole 22 in the state that the cutting blade 31 is exposed at a front end of a fixing body 32.

As described above, according to the present invention, the elastic pressing plate 80 presses the adhesive tape 10 by own elasticity so that the withdrawing of the adhesive tape 10 is carried out with the proper tension during the taping work as if the user withdrew the adhesive tape 10 by hand.

Therefore, the loose or irregular attaching of the adhesive tape is prevented and uniform adhesion state is realized.

Further, the adhesive tape wound in the shape of roll is prevented from being released more than a required length by inertia, and the released adhesive tape is prevented from being adhered to each other.

Furthermore, the cutter controller keeps the cutter protecting cover in the locked state not to be opened and unlocks the cutter protecting cover to rotate axially for carrying out the cutting work by the cutter part if required.

Therefore, the dispenser of an adhesive tape according to the present invention is very useful with improved reliability.

Although the foregoing description has been made with reference to the preferred embodiments, it is to be understood that changes and modifications of the present invention may be made by the ordinary skilled in the art without departing from the spirit and scope of the present invention and appended claims.

What is claimed is:

1. A dispenser of an adhesive tape, comprising:

a case body having a body case formed with a holding part to mount an adhesive tape inside, a coupling case coupled with the body case and formed with an assembling space at a rear part, and a cover case formed with a fitting piece at a front part to be coupled in the assembling space, wherein the case body is formed with a mounting hole at a front part and an exposure space at an upper part of the mounting hole, wherein the cover case is formed with a hook piece having a hook protrusion at a bottom surface, and the body case is formed with a holding protrusion at a bottom surface, so that the holding protrusion is held by the hook protrusion for keeping a coupling state between the cover case and the body case;

a cutter part mounted in a mounting hole of the case body; and an elastic pressing plate positioned at an upper part of the holding part for pressing the adhesive tape downward elastically to keep tension when the adhesive tape is released.

2. The dispenser of an adhesive tape as claimed in claim 1, wherein the body case and the cover case forming the case body are formed with elastic pieces having protrusion parts protruded inward.

3. The dispenser of an adhesive tape as claimed in claim 2, wherein the cover case is formed with a hook piece having a hook protrusion at a bottom surface, and the body case is formed with a holding protrusion at a bottom surface, so that the holding protrusion is held by the hook protrusion for keeping a coupling state between the cover case and the body case.

4. The dispenser of an adhesive tape as claimed in claim 2, wherein the body case and the coupling case forming the case body are formed with guide pieces protruded symmetrically and laterally at lower parts, and the coupling case is formed with a downward protrusion piece in the end of a center part thereof.

5. The dispenser of an adhesive tape as claimed in claim 2, further comprising:

a cutter protecting cover positioned at a rear part of a cutter part for alternatively opening or closing the exposure space at the upper part of the mounting hole;

a return spring supported by a lower part of the cutter protecting cover and an inner bottom surface of the case body for axially rotating the cutter protecting cover alternatively; and a cutter controller protruded from an inside of the case body outward for alternatively controlling opening or closing of the cutter protecting cover to operate the cutter part under user's desired situations.

6. The dispenser of an adhesive tape as claimed in claim 1, wherein the body case and the coupling case forming the case body are formed with guide pieces protruded symmetrically and laterally at lower parts, and the coupling case is formed with a downward protrusion piece in the end of a center part thereof.

7. The dispenser of an adhesive tape as claimed in claim 1, further comprising:

a cutter protecting cover positioned at a rear part of a cutter part for alternatively opening or closing the exposure space at the upper part of the mounting hole;

a return spring supported by a lower part of the cutter protecting cover and an inner bottom surface of the case body for axially rotating the cutter protecting cover alternatively; and a cutter controller protruded from an inside of the case body outward for alternatively controlling opening or closing of the cutter protecting cover to operate the cutter part under user's desired situations.

* * * * *